United States Patent [19]

Bailey et al.

[11] 4,110,233

[45] Aug. 29, 1978

[54] LITHIUM BASE GREASE CONTAINING POLYISOBUTYLENE

[75] Inventors: Wayne W. Bailey; Brian W. Taylor, both of Gibsonia, Pa.

[73] Assignee: Gulf Research & Development Company, Pittsburgh, Pa.

[21] Appl. No.: 754,250

[22] Filed: Dec. 27, 1976

[51] Int. Cl.[2] ..... C10M 1/24; C10M 3/18; C10M 5/14; C10M 7/20

[52] U.S. Cl. ..... 252/41; 252/59

[58] Field of Search ..... 252/41, 59

[56] References Cited

U.S. PATENT DOCUMENTS

| | | | |
|---|---|---|---|
| 2,275,123 | 3/1942 | Zimmer et al. | 252/42 |
| 2,732,356 | 1/1956 | Paxton | 252/41 |
| 3,663,726 | 5/1972 | Waring | 252/41 |
| 3,813,338 | 5/1974 | Coppock et al. | 252/41 |

*Primary Examiner*—Irving Vaughn

[57] ABSTRACT

A lubricating composition having improved resistance to removal by water, improved pumpability over a wide range of ambient temperatures, and the ability to float on water comprising a petroleum base oil thickened with a lithium soap of a fatty acid and containing a polyisobutylene of a molecular weight to provide such properties.

9 Claims, No Drawings

LITHIUM BASE GREASE CONTAINING POLYISOBUTYLENE

BACKGROUND OF THE INVENTION

1. Field of Invention

This invention relates to a lubricating grease composition having improved resistance to removal by water, improved pumpability over a wide range of ambient temperatures, and the ability to float on water which is specially suitable for lubrication of heavy steel processing equipment.

2. Description of Prior Art

Lubricating greases thickened with a lithium soap of a fatty acid are commonly used in steel mills for the general purpose lubrication of heavy steel processing equipment. Specific improvements in such greases are needed in view of current trends toward more severe operating conditions and better pollution control. Although no doubt many attempts have been made in the past to overcome the difficulties involved in successfully formulating a grease composition which simultaneously possesses (1) resistance to removal by water so that the grease tends to remain on the lubricated bearing, (2) pumpability over a wide range of ambient temperatures, and (3) the ability to float on water to allow the grease, even after severe contamination, to be skimmed from the top of a settling pond as an effective, inexpensive means of water pollution control, none has been successful until the present invention.

The prior art has been aware of the use of polyisobutylene for its adhesive properties. However, the polyisobutylene employed has been one of relative low molecular weight. An example of this grease composition is described in U.S. Pat. No. 3,663,726. The lithium base grease composition in U.S. Pat. No. 3,663,726 contains 3 to 20 percent by weight of a lithium soap thickener, 70 to 96 percent by weight of a hydrocarbon lubricating oil having a viscosity ranging from 40 to 165 SUS at 210° F and 1 to 25 percent by weight of a linear polyisobutylene having a molecular weight of from 5,000 to 20,000 (Staudinger) to obtain lubricating grease having a consistency of about 220 to 430 penetration number as measured by ASTM D-217. This composition has been formulated and evaluated as Example No. 8 in the experimental data herein and does not have the desired properties demonstrated by the grease composition described in this disclosure.

SUMMARY OF THE INVENTION

The present invention is directed to a lubricating grease composition specially suitable for the lubrication of heavy steel processing equipment and having improved resistance to removal by water, improved pumpability over a wide range of ambient temperatures and the ability to float on water which comprises:

(1) a petroleum base oil of lubricating viscosity,
(2) a lithium soap of a fatty acid and
(3) a polyisobutylene in an amount from about 5 to about 12.5 percent by weight of the lubricating grease composition and a molecular weight from about 75,000 to about 125,000 to confer said improved resistance to removal by water, pumpability and ability to float on the composition.

BRIEF DESCRIPTION OF THE INVENTION

The lubricating grease composition of this invention comprises a petroleum base oil having a lubricating viscosity, a lithium soap of a fatty acid as a thickener and a polyisobutylene of a molecular weight sufficient to provide the desired properties.

Petroleum Base Oil

Generally, the petroleum base oil comprises between about 75 to about 90 percent by weight, and preferably between about 75 to about 85 percent by weight of the grease composition. Satisfactory results have been obtained by using petroleum base oils such as a paraffinic oil, naphthenic oil, or blends of such oils. These oils can be derived from almost any petroleum crude or from sources such as coal, shale, and tar sands. Base oils that can be used herein are defined in Table 1.

TABLE 1

| Properties of Petroleum Base Oils Used Preparing Greases | Broad Range | Preferred Range |
|---|---|---|
| Viscosity, cs, ASTM D-445 | | |
| 37.8° C | 48 to 135 | 100 to 120 |
| 98.9° C | 7 to 13 | 8 to 10 |
| Sp. Gravity, 15.6° C | 0.9279 to 0.8654 | 0.90 to 0.92 |

Especially preferred base oils for the purpose of the present invention include 500 Texas Oil, 500 Paraffinic Texas Oil, Hydrofinished Medium Neutral Oil, and Hydrofinished Heavy Neutral Oil. These are defined in Table 2.

Table 2

| Base Oil | Properties of Base Oils | | | | | |
|---|---|---|---|---|---|---|
| | 500 Texas Oil | Hydro-finished Medium Neutral Oil | Hydro-finished Heavy Neutral Oil | Black Oil | 150 MC Bright Stock | 500 Paraffinic Texas Oil |
| Viscosity, cs. | | | | | | |
| 37.8° C | 109.9 | 50.55 | 129.5 | 885 | 555.3 | 109.9 |
| 98.9° C | 8.68 | 7.0 | 12.62 | 32.8 | 32.73 | 9.58 |
| Viscosity Index | 30 | 104 | 96 | 58 | 96 | 60 |
| Sp. Gravity, 15.6° C | 0.9176 | 0.8735 | 0.8822 | 0.949 | 0.8961 | 0.8978 |

Lithium Soap

The petroleum base oil used in the present invention is thickened to a grease consistency by a lithium soap of a fatty acid. Lithium soaps in the present invention can be employed in amounts from about 3 to about 20 percent by weight of the grease composition, preferably from about 4 to about 9 percent by weight of the grease composition, and most preferably from about 5 to about 7 percent by weight. Lithium soaps normally used to thicken greases can be used, and they include lithium salts of higher molecular weight acids, for example, acids of 10 to 30, and preferably 16 to 24 carbon atoms, of either synthetic, animal, or vegetable origin. Other carboxylic acids useful in conjunction with lithium salts for thickening greases include those derived from tallows, hydrogenated fish oil, hydrogenated castor oil, wool grease, and rosin. Generally, the lithium salts of acids such as lauric, palmitic, oleic, stearic and the like are used. One of the preferred lithium soaps for use in the present invention is the lithium soap of 12-hydroxystearic acid. Examples of suitable lithium soaps of fatty acids for this invention are lithium stearate, lithium palmitate, lithium oleate, lithium behenate, lithium archidate, lithium 12-hydroxystearate, and lithium tallowate.

The preparation of lithium soaps is well known and generally is carried out by heating the lithium hydroxide monohydrate with the fatty acid in a saponification vessel. The soap may be formed in the kettle in which the soap is to be dispersed in the oil or in a separate vessel.

Polyisobutylene

The lubricating grease composition in accordance with this invention is provided by dispersing a controlled amount of a polyisobutylene into the petroleum base oil thickened with the lithium soap. The amount of polyisobutylene added to the petroleum base oil thickened with the lithium soap is, of course, dependent on the viscosity of the petroleum base oil used in preparing the lubricating grease composition. Generally, the lubricating grease composition contains from about 5 to about 12.5 percent by weight, preferably between about 8 to about 12 percent by weight of the polyisobutylene. Particularly satisfactory results are obtained using a polyisobutylene having an average molecular weight of about 100,000 as measured by the Staudinger method. While a polyisobutylene having an average molecular weight of about 85,000 to about 110,000 (Staudinger) especially about 100,000 is preferred, the polyisobutylene suitable for use in the present invention can vary in average molecular weight from about 75,000 to 125,000 as measured by the Staudinger method. The preparation of polyisobutylene is well known to those skilled in the art. A polyisobutylene which is especially desirable for use in this invention can be purchased from the Lubrizol Corporation under the tradename, Lubrizol 3140. In order to incorporate the polyisobutylene in the grease composition, the polyisobutylene is dissolved in a petroleum base oil at grease manufacturing temperatures. However, the polyisobutylene may be added either in the form of a solid or as an oil solution of the polyisobutylene. The polyisobutylene of this invention is added in the form of an oil solution of the polyisobutylene, for example, as a 20 percent solution of the polyisobutylene in a petroleum base oil.

Polyisobutylene is added in am amount sufficient to provide a lubricating grease composition having a final viscosity of about 50 to 250 centistokes at 98.9° C, preferably between about 120 to 250 centistokes as measured by ASTM D-455.

Additives

The lubricating grease composition of the present invention can contain additives, if desired, to improve other specific properties. Thus, the lubricating grease composition can contain an antioxidant, a dispersant, an anticorrosion agent, a rust inhibitor, a metal deactivator, other extreme pressure agents, an antiwear agent, a tackiness agent, a dye and the like. Whether or not such additives are employed and the amounts used depend to a large extent upon the severity of the conditions to which the composition is subjected. When such additives are employed, they are generally added in amounts between 0.01 and about 10 percent by weight based on the weight of the total composition, preferably about 0.2 to about 5 percent by weight. They may be added prior to, during, or after the heating steps depending upon the thermal stability of the particular additive employed as will be apparent to those skilled in the art. Ordinarily, the additives are added after the other ingredients have been combined.

The improved lubricating grease of this invention can be manufactured according to conventional techniques. For example, the lubricating grease composition of the present invention can be prepared by a pressure saponification process as set forth in U.S. Pat. No. 2,847,382.

Typically, the lubricating grease composition of the present invention can be prepared by combining the petroleum base oil and the lithium soap components in a pressure vessel having a stirrer. The vessel containing the grease component is closed and heated to about 400° to about 475° F (204° to 246° C), preferably about 450° F (232° C). The contents in the vessel are heated and stirred for about 15 minutes to 1 hour, preferably about 30 minutes until the vessel attains an internal pressure of about 50 to 75 preferably about 65 psig. After reaching the desired pressure the vapors from the contents of the vessel are vented and heat is applied for about 15 to about 30 minutes, preferably about 30 minutes until the vessel and contents return to atmospheric pressure. To insure that dehydration of the grease is substantially complete, a vacuum of 20 inches of mercury is applied for about 5 to 10 minutes. When the temperature of the mixture reaches about 250° to about 325° F (121° to 163° C), preferably about 300° F (149° C), the mixture is transferred to an open kettle and a polyisobutylene is added by stirring. As the temperature of the grease reaches about 200° to about 250° F (93° to 121° C), preferably about 225° F (107° C) the additives are added. The grease is further cooled to about 150° to about 200° F (66° to 93° C), preferably about 160° to 170° F (71° to 77° C) and milled in a colloid mill at a desired clearance, about 0.001 to about 0.010 inches, preferably about 0.004 inches.

The present invention will be further described by the experimental data.

DESCRIPTION OF PREFERRED EMBODIMENTS

The petroleum base oils used in the experiments were:

(1) 500 Texas Oil
(2) Hydrofinished Medium Neutral Oil
(3) Hydrofinished Heavy Neutral Oil
(4) Black Oil
(5) 150 MC Bright Stock
(6) 500 Paraffinic Texas Oil or blends thereof. The general properties of these petroleum base oils have been given in Table 2.

The petroleum base oils used in the experiments were thickened with a lithium soap of a fatty acid. By the term "lithium soap #1" in the data is meant the reaction product of nine parts of hydrogenated castor oil and one part of tallow with a stoichiometric amount of lithium hydroxide monohydrate. By the term "lithium soap #2" in the data is meant the reaction product of 8.55 parts of hydrogenated castor oil, 0.95 parts tallow, and 0.5 parts naphthenic acid. In the working examples, the lithium soap was prepared in situ. By the term "aluminum complex soap" used in the data is meant the reaction product of one mole of $C_{20}$–$C_{22}$ fatty acids and one mole of benzoic acid with ⅓ mole or trioxyaluminum triisopropoxide as described in U.S. Pat. No. 3,776,846. The preparation of these soaps is well known in the grease art.

The term "Polyisobutylene A" used in the data is a pale yellow, highly viscous liquid known as Lubrizol 3140 available from the Lubrizol Corporation. Polyisobutylene A, as used in the grease formulations in the experiments, is a solution comprising 20 percent polyisobutylene dispersed in 80 percent petroleum base oil. "Polyisobutylene B" used in the data is the polyisobutylene polymer described in U.S. Pat. No. 2,062,346, tradename Paratac available from Enjay Company, Inc. "Polyisobutylene C" is Lubrizol 3174 available from Lubrizol Corporation. Polybutenes used in the experiments included Polybutene 32 available from the Chevron Corporation and Polybutene H-300 available from the American Oil Corporation. Other well known polymers used in the experiments included Lubrizol 3708, a styrene methacrylate copolymer, available from the Lubrizol Corporation and Acryloid 702, a methacrylate copolymer, available from the Rohm & Haas Company.

The general properties of these polymers are given in Table 3.

Table 3

| | Properties of Polymers | | | | | | |
|---|---|---|---|---|---|---|---|
| | Polyiso-butylene A | Polyiso-butylene B | Polyiso-butylene C | Poly-butene 32 | Poly-butene H-300 | Lubrizol 3708 | Acryloid 702 |
| Mole. wt. (ave) | 100,000 | 50,000 | 20,000 | 1400 | 1290 | 75,000 | 597,000 |
| Active Soln.: % | 20.0 | 5.0 | 100 | 100 | 100 | 39.0 | 41.0 |
| Sp. Gr. 15.6° C | 0.88 | 0.892 | 0.905 | 0.908 | 0.898 | 0.91 | 0.907 |
| Viscosity, cs | 643 | 2894 | 812, | 641 | 650 | 710 | 1350 |
| Pour Point: ° C | −12 | −7 | 0 | 4 | 2 | −7 | 4 |

The standard package of additives, referred to as "Additives" in the data are described in detail in Table 4, and together comprise about 4.50 percent by weight of the final lubricating grease composition.

Table 4

| Name | Amount (wt.%) | Additives Description |
|---|---|---|
| 1. Condensation product of N-dimethyl aniline and formaldehyde | 11.11 wt. % | Antioxidant; available as Ortholeum 304 from DuPont Corporation. |
| 2. Calcium alkylamidophthalate | 22.22 wt. % | Antioxidant, antirust agent, detergent; as described in U. S. 2,378,442. |
| 3. Chlorinated paraffin wax | 8.89 wt. % | Pressure carrier; approximately 40% chlorine; available as Chlorowax 40 from Diamond Shamrock Corporation. |
| 4. Sulfurized hydrocarbon | 33.33 wt. % | E.P. agent; a sulfurized olefin containing 43 weight percent sulfur. Available as Anglamol 33 from The Lubrizol Corporation. |
| 5. Zinc dialkyldithiophosphate | 24.45 wt. % | Antioxidant, bearing corrosion inhibitor antiwear agent, pressure carrier; available as Lubrizol 139 from The Lubrizol Corporation. |

After the greases were prepared, they were subjected to four tests. These tests include:

(1) Penetration, described in ASTM D-217.

(2) Ternstedt Water Spray Resistance Test described below.

(3) United States Steel (USS) Mobility Test described in *Lubrication Engineers Manual,* compiled and edited by Charles A. Bailey and Joseph S. Aarons, United States Steel Corporation, 1971 edition, pages 108–109.

(4) United States Steel (USS) Flotation Test described below.

An acceptable value for ASTM D-217 unworked is 265 to 340 and worked (60 strokes) is 265 to 340. An acceptable value for the Ternstedt Water Spray Resistant Test is 50 percent and lower. An acceptable value for the United States Steel Mobility Test is 0.05 g/s or higher at 0° F (−17.8° C). An acceptable value for the United States Steel Flotation test is "Float".

Ternstedt Water Spray Resistance Test

Water spray resistance is a measure of the ability of a grease to adhere to a metal surface when subjected to an intense spray of water. A test panel measuring 2 × 4 inches made of stainless steel is weighed; a 1/32 inch coat of grease film is applied to a 2 × 4 inch surface area of the test panel; and the test panel is weighed again to determine the amount of grease applied to the surface area. The test panel containing the grease is placed 12 inches below the spray nozzle. The grease-coated test panel is subjected to a spray of water maintained at a temperature of 100° F (37.8° C) and 20 psi upstream nozzle pressure. The nozzle is a Spraying Systems Company "Full Jet" No. ½ GG-25 spray nozzle. The contact area of the water spray with the test panel measures approximately 16 inches in diameter which ensures that the test panel, when centered in the middle of the spray, will be completely covered. All the grease outside the 2 × 4-inch test area of the sprayed panel is removed by means of a spatula. The sprayed test panel is dried for 1 hour at 150° F (66° C) in a horizontal position in an air convection oven. The test panel is cooled to room temperature and weighed to determine the weight of the grease remaining on the test area of the panel.

USS Flotation Test

Fifty grams of grease are mixed with 10 grams of mill scale ore (waste material scraped from steel surfaces usually containing iron oxides, dust, dirt, etc.) supplied by United States Steel Research Center, Monroeville, Pennsylvania. The grease mixture is added to the roll stability tester described in ASTM D-1831 along with 50 ml water. The roll stability tester is allowed to rotate 2 hours at room temperature at a speed of 165 ± 15 RPM. At the completion of the rolling period, a 10 gram sample of grease is allowed to fall a distance of 12 inches into a 1,000 ml breaker containing 900 milliliters of tap water. The contaminated grease is observed to "float" or "sink".

EXAMPLE 1

The lubricating grease composition of the present example was prepared by combining 638 grams 500 Texas Oil, 22.5 grams tallow, 202.5 grams hydrogenated castor oil, 33.7 grams lithium hydroxide monohydrate, and 8 grams water in a pressure vessel with a stirrer. The vessel was closed and heated to about 450° F (232° C). The contents in the vessel were heated and stirred continuously for about a half hour until the vessel attained an internal pressure of about 65 psig (about 4.57 kilograms per square centimeter). After the desired pressure was attained, the vapors from the contents of the vessel were vented by continuing to heat for about a half hour until the vessel and contents returned to atmospheric pressure. Although dehydration of the grease was substantially complete, a vacuum of 20 inches of mercury was applied for about 5 minutes to further dehydrate the grease mixture. One thousand seventy one grams 500 Texas Oil were stirred into the grease mixture. The temperature of the mixture was about 300° F (149° C). The mixture was then transferred to an open kettle where 1789 grams of Polyisobutylene A (a polyisobutylene having an average molecular weight of 100,000 as measured by Staudinger method) were added with stirring. The temperature of the grease was about 225° F (107° C). One hundred eighty grams of the standard additives listed in Table 4 were added to the grease mixture. The grease was cooled to 160° to 170° F (71° to 77° C) and milled in a colloid mill at 0.004 inch clearance.

A first series of lubricating grease compositions following the procedure in example 1 was prepared using identical materials except that the percentage of Polyisobutylene A was varied. The results of this series are reported in Table 5 as Examples 2 through 6.

Table 5

| | Lubricating Grease Compositions Using Varied Amounts of Polyisobutylene | | | | | |
|---|---|---|---|---|---|---|
| Example No. | 1 | 2 | 3 | 4 | 5 | 6 |
| Make-up, wt.% | | | | | | |
| 500 Texas Oil | 44.73 | 80.50 | 67.09 | 31.30 | 22.36 | — |
| Polyisobutylene A (solution)[1] | 44.72 | 8.95 | 22.36 | 58.70 | 67.09 | 89.45 |
| Lithium Soap #1 | 5.50 | 5.50 | 5.50 | 5.50 | 5.50 | 5.50 |
| Glycerine (Theor.) | 0.55 | 0.55 | 0.55 | 0.55 | 0.55 | 0.55 |
| Additives[2] | 4.50 | 4.50 | 4.50 | 4.50 | 4.50 | 4.50 |
| Inspections | | | | | | |
| Penetration | | | | | | |
| (unworked) | 293 | 300 | 295 | 295 | 285 | 410 |
| (worked, 60 strokes) | 296 | 303 | 295 | 295 | 283 | 432 |
| Ternstedt Water Spray Resistance Test (%) | 31.1 | 67.9 | 53.3 | 18.2 | 65.5 | 89.4 |
| USS Mobility Test 0° F (−17.8° C) (g/s) | 0.10 | 0.212 | 0.17 | 0.08 | 0.068 | 0.011 |
| USS Flotation Test (Sink or Float) | Float | Float | Float | Float | Float | Float |
| Base Oil Inspections | | | | | | |
| Viscosity, cs 98.9° C | 126 | 18.59 | 42.7 | 249 | 450 | 643 |

[1]To calculate the amount of solid Polyisobutylene A used the solution value is multiplied by 0.20. For example, in Example 1, 44.72 weight percent Polyisobutylene A (solution) × 0.20 = 8.94 weight percent of Polyisobutylene A (solid).
[2]See Table 4, items 1-5.

Referring to Table 5, it can be seen that the excellent lubricating grease compositions are Examples 1 and 4 where the amount of Polyisobutylene A (solid) 8.4 and 11.74 percent of the composition, respectively. In Examples 1 and 4 acceptable values were obtained for all three tests, i.e., the Ternstedt Water Spray Resistance, the USS Mobility Test, and the USS Flotation Test. When the amount of polyisobutylene is too high, as shown in Examples 5 and 6, not only does the Ternstedt Water Spray Resistance Test degrade, but the USS Mobility Test also degrades. When the polyisobutylene content is too low, as shown in Examples 2 and 3, the Ternstedt Water Spray Resistance Test is also seriously degraded. In Examples 1 and 4 the viscosity of the final grease composition was 126 and 249 cs, respectively.

A second series of lubricating grease compositions was prepared identical to Example 1 of the first series of compositions, except that other polyisobutylenes of differing average molecular weight as measured by the Staudinger method and other copolymer compounds well known in the art were substituted for Polyisobutylene A. The results of this series are reported in Table 6. As Examples 7 through 12.

Table 6

| | Lubricating Grease Compositions Using Various Polymers | | | | | | |
|---|---|---|---|---|---|---|---|
| Example No. | 1 | 7 | 8 | 9 | 10 | 11 | 12 |
| Make-up, wt.% | | | | | | | |
| 500 Texas Oil | 44.73 | 44.73 | 44.73 | 44.73 | 44.73 | 44.73 | 44.73 |
| Lithium Soap #1 | 5.50 | 5.50 | 5.50 | 5.50 | 5.50 | 5.50 | 5.50 |
| Glycerine (Theor.) | 0.55 | 0.55 | 0.55 | 0.55 | 0.55 | 0.55 | 0.55 |
| Additives[2] | 4.50 | 4.50 | 4.50 | 4.50 | 4.50 | 4.50 | 4.50 |
| Polyisobutylene A (Solution)[1] | 44.72 | — | — | — | — | — | — |
| Polyisobutylene B (Solution) | — | 44.72 | — | — | — | — | — |
| Polyisobutylene C (Solution) | — | — | 44.72 | — | — | — | — |
| Polybutene 32 | — | — | — | 44.72 | — | — | — |
| Polybutene H-300 | — | — | — | — | 44.72 | — | — |
| Lubrizol 3708 | — | — | — | — | — | 44.72 | — |
| Acryloid 702 | — | — | — | — | — | — | 44.72 |
| Inspections | | | | | | | |
| Penetration ASTM D-217 | | | | | | | |

Table 6-continued

| Example No. | Lubricating Grease Compositions Using Various Polymers 1 | 7 | 8 | 9 | 10 | 11 | 12 |
|---|---|---|---|---|---|---|---|
| (Unworked) | 293 | 308 | 255 | 264 | 284 | 346 | 333 |
| (Worked, 60 strokes) | 296 | 315 | 257 | 270 | 282 | 348 | 341 |
| Ternstedt Water Spray Resistance Test (%) | 31.1 | 73.5 | 4.2 | 6.5 | 8.9 | 79.2 | 84.2 |
| USS Mobility Test 0° F (−17.8° C) (g/s) | 0.10 | 0.04 | 0.001 | 0.014 | 0.01 | 0.014 | 0.011 |
| USS Flotation Test (Sink or Float) | Float | Float | Float | Float | Float | Float | Float |

[1]See footnote 1 in Table 5.
[2]See Table 4, items 1-5.

Polymers other than Polyisobutylene A failed to obtain acceptable values for all three tests, i.e., Ternstedt Water Spray Resistance, USS Mobility, and USS Flotation. In all cases Examples 7, 8, 9, 10, 11, and 12 employing polymers other than Polyisobutylene A, whose properties are listed in Table 3, had extremely poor USS Mobility Test values and Examples 7, 11 and 12 additionally, had extremely poor Ternstedt Water Spray Resistance Test Values.

A third series of lubricating grease compositions was prepared identical to Example 1 of the first series of compositions, except that various base oils were substituted for 500 Texas Oil. The results of this series are reported in Table 7, as Examples 13 through 17.

Table 7

| Example No. | Lubricating Grease Compositions Using Various Base Oils 1 | 13 | 14 | 15 | 16 | 17 |
|---|---|---|---|---|---|---|
| Make-up, wt.% | | | | | | |
| 500 Texas Oil | 44.73 | — | — | — | — | — |
| Hydrofinished Heavy Neutral Oil | — | 44.73 | 44.01 | — | — | — |
| 500 Paraffinic Texas Oil | — | — | — | 44.73 | — | — |
| Hydrofinished Medium Neutral Oil | — | — | — | — | — | — |
| Black Oil | — | — | — | — | 44.73 | — |
| 150 MC Bright Stock | — | — | — | — | — | 44.73 |
| Lithium Soap #1 | 5.50 | 5.50 | — | 5.50 | 5.55 | 5.55 |
| Lithium Soap #2 | — | — | 7.00 | — | — | — |
| Glycerine (Theor) | 0.55 | 0.55 | 0.49 | 0.55 | 0.55 | 0.55 |
| Polyisobutylene A (Solution)[1] | 44.72 | 44.72 | 44.72 | 44.72 | 44.72 | 44.72 |
| Additives[2] | 4.50 | 4.50 | 4.50 | 4.50 | 4.50 | 4.50 |
| Inspections | | | | | | |
| Penetration ASTM D-217 | | | | | | |
| (Unworked) | 293 | 450+ | 284 | 312 | 376 | 450+ |
| (Worked, 60 strokes) | 296 | Semi-fluid | 286 | 314 | 384 | Semi-fluid |
| Ternstedt Water Spray Resistance Test (%) | 31.1 | 99+ | 32.4 | 47.3 | 91.1 | 99+ |
| USS Mobility Test 0° F (−17.8° C) (g/s) | 0.10 | — | 0.11 | 0.12 | 0.11 | — |
| USS Flotation Test (Sink or Float) | Float | — | Float | Float | Float | — |
| Base Oil Inspections | | | | | | |
| Viscosity, cs 98.9° C | 126 | 136 | 136 | 123 | 234 | 227 |

[1]See footnote 1 in Table 5.
[2]See Table 3, items 1-5.

As can be seen from Table 7, the preferred base oils include 500 Texas Oil (Example 1), Hydrofinished Heavy Neutral Oil (Example 14), 500 Paraffinic Texas Oil (Example 15). Hydrofinished Medium Neutral Oil is also a suitable base oil. While the base oil in Examples 13 and 14 was the same, Lithium soap #1 in Example 13 did not give the desired results because of poor solubility in the paraffinic oil. Consequently, the lithium soap of naphthenic acid incorporated in the soap make-up in a small concentration, previously described as Lithium Soap #2, optimizes the solubility of the lithium soap to give the desired gelation in a paraffinic oil system. This technique is well known to those of ordinary skill in the art.

A fourth series of lubricating grease compositions was prepared identical to Example 1 of the first series of compositions, except that various soaps were used as thickeners. The resuls of this series are reported in Table 8, as Examples 18 through 20.

Table 8

| Example No. | Lubricating Grease Compositions Using Various Metallic Soaps as Thickeners 1 | 18 | 19 | 20 |
|---|---|---|---|---|
| Make-up, wt.% | | | | |
| 500 Texan oil | 44.73 | 48.79 | 49.50 | 45.00 |
| 150 MC Bright Stock Polyisobutylene A (solution)[1] | 44.72 | — | — | 45.00 |
| Lithium Soap #1 | 5.50 | 6.00 | — | — |
| Al Complex Soap | — | — | 5.50 | 5.50 |
| Glycerine (Theor.) | 0.55 | 0.60 | — | — |
| Additives[2] | 4.50 | 4.50 | 4.50 | 4.50 |
| Inspections | | | | |
| Penetration, ASTM D-217 | | | | |
| (Unworked) | 293 | 283 | 279 | 313 |
| (Worked, 60 strokes) | 296 | 293 | 282 | 323 |
| Ternstedt Water Spray Resistance Test (%) | 31.1 | 79.4 | 67.9 | 27.5 |
| USS Mobility Test 0° F (−17.8° C) (g/s) | 0.10 | 0.12 | 0.11 | 0.032 |
| (Sink or Float) | Float | Sink | Sink | Float |
| Base Oil Inspections | | | | |
| Viscosity, cs 37.8° C | — | 229 | 229 | — |

Table 8-continued

| Lubricating Grease Compositions Using Various Metallic Soaps as Thickeners | | | | |
|---|---|---|---|---|
| Example No. | 1 | 18 | 19 | 20 |
| 98.9° C | 126 | 15.98 | 15.98 | 126 |

[1]See footnote 1 in Table 5.
[2]See Table 4, items 1-5.

As can be seen from the results reported in Table 8, the aluminum complex soap thickeners, Examples 19 and 20, do not simultaneously give the desired water spray resistance, mobility, and flotation values. Example 18 which is a lithium soap thickened grease without Polyisobutylene A does not give the desired water resistance value.

The examples set forth are to illustrate, not to limit, the invention, whereby those skilled in the art may understand more fully the nature in which the present invention can be carried into effect.

We claim:

1. A lubricating grease composition specially suitable for the lubrication of heavy steel processing equipment and having improved resistance of removal by water, improved pumpability over a wide range of ambient temperatures, and the ability to float on water consisting essentially of:

(1) a petroleum base of lubricating viscosity ranging from about 7 to about 13 centristokes as measured by ASTM D-445 at 98.9° C and having a specific gravity ranging from about 0.9279 to about 0.8654 at 15.6° C;

(2) a lithium soap of a fatty acid having from about 10 to about 30 carbon atoms as a thickener in an amount from about 3 to about 20 percent by weight of the lubricating grease composition; and (3) a polyisobutylene in an amount from about 5 to about 12.5 percent by weight of the lubricating grease composition and of a molecular weight from about 75,000 to about 125,000 as measured by the Staudinger method, to confer said improved water resistance and pumpability on the composition.

2. A lubricating grease composition according to claim 1 wherein the petroleum base oil is selected from the group consisting of a paraffinic oil, naphthenic oil, and blend of such oils having a viscosity ranging from about 8 to about 10 centistokes as measured by ASTM D-445 at 98.9° C and having a specific gravity ranging from about 0.90 to about 0.92 at 15.6° C; and the lithium soap of a fatty acid having from about 16 to about 24 carbon atoms.

3. A lubricating grease composition according to claim 8 wherein the amount of the petroleum base oil is from about 75 to about 90 percent bu weight; the amount of lithium soap is from about 4 to about 9 percent by weight and the lithium soap is selected from the group consisting of lithium stearate, lithium palmitate, lithium oleate, lithium behenate, lithium archidate, lithium 12-hydroxystearate and lithium tallowate.

4. A lubricating grease composition according to claim 3 wherein the polyisobutylene has an average molecular weight from about 85,000 to about 110,000 as measured by the Staudinger method.

5. A lubricating grease composition according to claim 4 wherein the amount of petroleum base oil is from about 75 to about 85 percent by weight; the amount of the lithium soap is from about 5 to about 7 percent by weight of the lubricating grease composition.

6. A lubricating grease composition according to claim 5 wherein the polyisobutylene has an average molecular weight of about 100,000 as measured by the Staudinger method.

7. A lubricating grease composition according to claim 3 wherein said lithium soap is lithium stearate.

8. A lubricating grease composition according to claim 3 wherein said lithium soap is lithium 12-hydroxystearate.

9. A lubricating grease composition according to claim 3 wherein said lithium soap is lithium tallowate.

* * * * *

UNITED STATES PATENT OFFICE

CERTIFICATE OF CORRECTION

Patent No. 4,110,233 Dated August 29, 1978

Inventor(s) Wayne W. Bailey and Brian W. Taylor

It is certified that error appears in the above-identified patent and that said Letters Patent are hereby corrected as shown below:

Col. 10, line 65, Table 8, After "(g/s)" insert on the following line --USS Flotation Test--.

Col. 12, Claim 3, line 13, "refer to Claim 8" should read --refer to Claim 2--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*